US005407494A

United States Patent [19]

Post

[11] Patent Number: 5,407,494

[45] Date of Patent: Apr. 18, 1995

[54] METHOD OF FABRICATING A WELDED METALLIC DUCT ASSEMBLY

[75] Inventor: Edwin E. Post, San Diego, Calif.

[73] Assignee: CRS Holdings, Inc., Wilmington, Del.

[21] Appl. No.: 171,224

[22] Filed: Dec. 21, 1993

[51] Int. Cl.[6] ..... B21B 19/00; B21C 37/00

[52] U.S. Cl. ..... 148/521; 228/155

[58] Field of Search ..... 148/521; 228/155

[56] References Cited

U.S. PATENT DOCUMENTS

| | | | |
|---|---|---|---|
| 3,298,096 | 1/1967 | Stuart | 29/477 |
| 3,383,900 | 5/1968 | Hartesveldt | 72/342 |
| 3,640,116 | 2/1972 | Hellman | 72/476 |
| 3,986,654 | 10/1976 | Hart et al. | 228/155 |
| 4,320,568 | 3/1982 | Herrod et al. | 29/421 R |
| 4,343,170 | 8/1982 | Hufton | 72/61 |
| 4,375,160 | 3/1983 | Verdickt | 72/208 |
| 4,429,824 | 2/1984 | Woodward | 228/157 |
| 4,433,567 | 2/1984 | Mead | 72/342 |
| 4,466,566 | 8/1984 | Good | 228/155 |
| 4,489,585 | 12/1984 | Palmer et al. | 72/387 |
| 4,499,924 | 2/1985 | Garrett | 138/110 |
| 4,534,196 | 8/1985 | Kiyoto et al. | 72/61 |
| 4,566,300 | 1/1986 | Gebelius | 72/63 |
| 4,569,218 | 2/1986 | Baker et al. | 72/342 |
| 4,573,841 | 3/1986 | Petkov et al. | 409/244 |
| 4,604,785 | 8/1986 | Eddens | 72/342.7 |
| 4,649,492 | 3/1987 | Sinha et al. | 364/472 |
| 4,692,978 | 9/1987 | Cunningham et al. | 29/157.3 |
| 4,915,166 | 4/1990 | Cunningham et al. | 165/184 |
| 4,926,667 | 5/1990 | Markiewicz et al. | 72/256 |
| 4,930,338 | 6/1990 | Tokura | 72/479 |
| 4,989,433 | 2/1991 | Harmon et al. | 72/38 |
| 4,991,419 | 2/1991 | Kuroda et al. | 72/97 |
| 5,027,635 | 7/1991 | Wilks | 72/342.7 |
| 5,058,411 | 10/1991 | Siemers et al. | 72/342.4 |

*Primary Examiner*—Upendra Roy

*Attorney, Agent, or Firm*—Dann, Dorfman, Herrell and Skillman

[57] ABSTRACT

A process for fabricating a welded metallic duct assembly includes the steps of forming tubing from a flat form of a metal or alloy, annealing the tubing while applying radially directed pressure to a surface thereof, and then welding an end of the tubing to an article such as a flange, fitting, connector, spacer, or similarly processed tubing to form a duct assembly. The annealing step includes thermal sizing of the tubing in a manner that relieves residual stresses resulting from the forming process. A welded duct assembly fabricated in accordance with this process is substantially free of distortion in the heat affected zone of the weld that adversely affects the fatigue life of the ducting.

16 Claims, No Drawings

METHOD OF FABRICATING A WELDED METALLIC DUCT ASSEMBLY

BACKGROUND OF THE INVENTION

This invention relates to a method for fabricating a metallic duct assembly by welding, and in particular, to a method in which a tubular member or duct that is used to fabricate the duct assembly is formed and heat treated so as to resist heat-induced distortion when subsequently welded.

Lightweight, very high strength materials are finding increasing use in the fabrication of structural components. The switch to such materials has arisen because of the need to reduce the weight of such structural components without sacrificing strength. More specifically, ventilation ducting for certain applications is now being made of thin-walled, titanium alloy tubing that has been press formed from relatively thin-gauge sheet material. Sections of the tubing are welded together, or to a fitting or connector, to form a duct assembly.

In practice it has been found that a portion of the tubing in the heat affected zone of the weld becomes distorted during the welding process. This distortion adversely affects the fatigue life of the duct assembly. Accordingly, it would be desirable to have a method of fabricating metallic tubing that renders the tubing resistant to distortion when it is subsequently welded during fabrication of a duct assembly.

A technique known as "thermal sizing" has been used to shape and precisely dimension hollow, thin-walled articles, such as nuclear fuel channels. In the process of thermal sizing, the "sizing" force or pressure results from the differential thermal expansion between two dissimilar metals or alloys. The hollow, thin-walled article is formed of a metal or alloy having a known coefficient of thermal expansion. Before the sizing treatment, the thin-walled article is mounted on or surrounded by a mandrel that is formed of a material having a coefficient of thermal expansion that is significantly greater than that of the thin-walled article. When the thus assembled article and mandrel are heated to an elevated temperature, the mandrel expands at a faster rate than the thin-walled article, thereby exerting radially directed pressure on the article. The article and mandrel materials are selected such that within a preselected temperature range, the mandrel will expand to an external, or internal, cross-sectional dimension that corresponds to the desired internal, or external, cross-sectional dimension of the sized article.

SUMMARY OF THE INVENTION

The above-described problem of distortion in a welded duct assembly formed of a high strength, lightweight metal or alloy is solved to a large degree in accordance with this invention whereby there is provided a novel method for fabricating a welded metallic duct assembly. The fabrication process in accordance with this invention includes the steps of forming tubing from a flat form of a metal or alloy, annealing the tubing while applying radially directed pressure to a surface thereof, and then welding the tubing to an end of another similarly processed tube, a fitting, or a connector to form a duct assembly.

The annealing step is preferably carried out by mounting the tubing on a mandrel having a cross section that is slightly smaller than the inside dimension of the unannealed tubing and a coefficient of thermal expansion that is substantially greater than that of the metal or alloy used to form the tubing, whereby a tubing/mandrel combination is formed. The tubing/mandrel combination is heated in an inert atmosphere or a vacuum to an elevated temperature sufficient to cause the mandrel to expand to a cross-sectional size that corresponds to the desired final inside cross-sectional size of the tubing. The tubing/mandrel combination is maintained at the elevated temperature for a time sufficient to substantially relieve residual stresses induced in the tubing by the forming operation. The tubing/mandrel combination is then cooled to a temperature at which the tubing and the mandrel can be readily separated.

The process according to this invention stems from the discovery that the distortion in the heat affected zone of a welded metallic duct assembly results from localized relaxation of residual stresses induced in the tubing during the forming operation. It has been found that a titanium alloy duct assembly fabricated in accordance with the method of this invention has little or no distortion in the as-welded condition, thereby providing excellent fatigue life and good dimensional consistency and uniformity from assembly to assembly.

DETAILED DESCRIPTION

In carrying out the process according to the present invention to make a welded metallic duct assembly, sheet material of appropriate length, width, and thickness is selected. The preferred material for use in this process is an alloy of titanium, such as Ti-15V-3Cr-3Al-3Sn or 21S, although it is contemplated that the process according to this invention can be used with other metals or alloys. The sheet material is press-formed, preferably on a brake-press machine of the type generally known in the art, to form a tube having a desired cross-sectional geometry. The preferred cross-sectional geometry is circular, however, another geometry such as an oval, elliptical, or polygonal cross section can be used when desired for a particular application. In forming the tubing in accordance with the present invention, the internal dimension of the tubing is formed slightly undersized relative to the finished product.

As a result of the press-forming operation, the opposite edges of the sheet material are brought into close proximity to each other to form an open longitudinal seam. The edges are welded together with a continuous longitudinal weld to close the seam. The preferred method of forming the longitudinal weld is tungsten inert gas (TIG) welding. The longitudinal weld is then reduced, for example by roll planishing, to smooth out the weld bead and minimize any circumferential distortion resulting from the forming and/or welding processes. In tubing having a round cross section, this additional step also improves the ovality of the tubing.

The tubing is then placed on a mandrel to form a tubing/mandrel combination. The mandrel is formed of a material that has a coefficient of thermal expansion that is significantly greater than that of the tubing material so that the mandrel will expand rapidly to the desired inside diameter of the tubing when the mandrel is heated to an elevated temperature. In this manner the tubing is precisely and reliably dimensioned. The preferred mandrel material is stainless steel, although a high temperature nickel-base alloy or the like can be used when desired.

The mandrel has a cross-sectional geometry that corresponds to the desired cross-sectional geometry of the finished tubing. The outside dimension of the mandrel is selected to provide a small gap between the mandrel and the tubing to facilitate placing the tubing on and removing it from the mandrel without marring the interior surface of the tubing.

The tubing/mandrel combination is placed in a pressure vessel which is then closed and sealed from the ambient atmosphere. The pressure vessel is evacuated to remove atmospheric gases and backfilled with an inert gas such as helium or argon. The pressure vessel is then placed in a heat treating furnace and heated until the tubing/mandrel combination reaches an elevated temperature that is sufficient to cause expansion of the mandrel to the desired final inside dimension of the tubing. The expansion of the mandrel during heating applies radially directed pressure to the interior surface of the tubing causing it to expand plastically to the desired size. The backfill pressure of the inert gas is controlled so as to avoid exceeding the pressure rating of the vessel when the pressure increases inside the vessel as a result of heating the inert gas at constant volume. As an alternative to using an inert gas, the interior of the pressure vessel can be maintained at sub-atmospheric pressure during the heating step.

The tubing/mandrel combination is held at the elevated temperature for a time sufficient to ensure that it is uniformly heated to the desired temperature and to ensure that residual stresses in the tubing are fully relieved. The hold time at temperature is readily selected based on the size and wall thickness of the tubing and the size of the mandrel.

When the tubing/mandrel combination has been thoroughly heated, the pressure vessel is removed from the furnace and allowed to cool. The tubing/mandrel combination is cooled inside the pressure vessel in the presence of the inert gas, or under vacuum as the case may be, to a temperature at which the tubing and the mandrel can be readily separated.

The tubing is separated from the mandrel and prepared in any known manner to be welded to similarly processed tubing. A pair of tubes are welded together to form a duct assembly with the welding being carried out with any suitable, known technique. In one embodiment of the process a pair of tubes are aligned end-to-end on a welding fixture and welded together circumferentially. The ends of the respective tubes may be expanded slightly prior to welding in order to improve roundness, in the case of circular cross-section ducts, and to facilitate alignment of the ends. Those skilled in the art will readily appreciate that the tubing can also be fitted up for welding to a flange, spacer, connector, or the like, to form a duct assembly in accordance with the present invention.

The preferred technique for welding the duct assembly is TIG. In making the weld, filler wire can be used when necessary. The plasma arc welding technique also provides satisfactory results and may be used when desired.

By way of example, tubes approximately 20 feet long and having a wall thickness of 0.020 in. and a circular cross section were formed from Ti-15V-3Cr-3Al-3Sn alloy sheet on a brake-press. The tubes were assembled onto mandrels of AISI Type 304 stainless steel and thermally formed to an outside diameter of about 7.000 in. Thermal forming of the tubes was performed by heating the tubing/mandrel combinations in a pressure vessel backfilled with helium gas to an annealing temperature in the range 1400°–1450° F. and holding at the annealing temperature for about 5 minutes. The tubing/mandrel combinations were cooled to just below 400° F. in the pressure vessel in the presence of the helium gas and then separated. The tubes were subsequently welded together to form a duct assembly. After welding there was little or no distortion of the tubing in the heat affected zone of the weld.

In view of the foregoing, a method has been described which is useful for fabricating a welded, metallic duct assembly from metallic tubing in which the tubing is precisely dimensioned and relieved of internal stresses before it is welded. A duct assembly fabricated in accordance with the described method is substantially free of distortion in the heat affected zone of the weld between respective tubes. The disclosed process is particularly advantageous in the fabrication of welded duct assemblies made from titanium or a titanium alloy.

The terms and expressions which have been employed herein are used as terms of description, not of limitation. There is no intention in the use of such terms and expressions of excluding any equivalents of the features shown and described or portions thereof. However, it is recognized that various modifications are possible within the scope of the invention claimed.

What is claimed is:

1. A process for fabricating a duct assembly comprising the steps of:

forming tubing from a flat form of a metal or alloy;

annealing said tubing while applying radially directed pressure to a surface thereof; and then circumferential welding an end of said tubing to an article selected from the group consisting of a fitting, a tubular spacer, a connector, a flange, or similarly prepared tubing.

2. The process set forth in claim 1 wherein the step of forming the tubing comprises the steps of:

selecting a sheet of the metal or alloy, said metal or alloy having a desired coefficient of thermal expansion;

forming said sheet into a channel having a desired cross-sectional geometry, said sheet being formed such that opposite edges of said sheet are brought into close proximity to each other to form a longitudinal seam; and welding the opposite edges of said sheet along said longitudinal seam to close said channel.

3. The process set forth in claim 1 wherein the step of annealing said tubing comprises the steps of:

mounting the tubing on a mandrel having a cross section that is smaller and a coefficient of thermal expansion that is substantially greater than that of the metal or alloy used to form said tubing, whereby a tubing/mandrel combination is formed;

heating the tubing/mandrel combination to an elevated temperature sufficient to cause the mandrel to expand to a cross-sectional size that corresponds to a desired inside cross-sectional size for said tubing;

maintaining the tubing/mandrel combination at said elevated temperature for a time sufficient to substantially relieve residual stresses in said tubing; and then cooling said tubing/mandrel combination to a temperature at which said tubing and said mandrel can be readily separated.

4. The process set forth in claim 1 wherein the step of welding the tubing to the article comprises the steps of:

aligning the end of said first tubing with an end of the article; and then forming a circumferential weld between the tubing and the article to join them together.

5. The process according to claim 3 wherein the step of heating the tubing/mandrel combination comprises the steps of:

placing the tubing/mandrel combination in a pressure vessel and then closing and sealing the pressure vessel;

evacuating the pressure vessel to remove atmospheric gases; and then placing the pressure vessel in a heat treating furnace.

6. The process set forth in claim 3 wherein the tubing is formed of a titanium alloy and the mandrel is formed of a stainless steel alloy.

7. The process set forth in claim 5 further comprising the step of backfilling the pressure vessel with an inert gas after it has been evacuated.

8. The process set forth in claim 6 wherein the tubing is circular in cross section.

9. A process for fabricating a duct assembly comprising the steps of:

forming first and second tubes from a flat form of titanium or a titanium alloy;

annealing said first and second tubes while applying radially directed pressure to a surface of each of said tubes; and then circumferential welding an end of said first tube to an end of said second tube.

10. The process set forth in claim 9 wherein the step of forming the tubes comprises the steps of:

selecting a sheet of titanium or titanium alloy having a desired coefficient of thermal expansion;

forming said sheet into a channel having a desired cross-sectional geometry, said sheet being formed such that opposite edges of said sheet are brought into close proximity to each other to form a longitudinal seam; and then welding the opposite edges of said sheet along said longitudinal seam to close said channel.

11. The process set forth in claim 9 wherein the step of annealing said tubes comprises the steps of:

mounting a tube on a mandrel having a cross-section that is smaller than, and a coefficient of thermal expansion that is greater than that of the titanium or titanium alloy used to form said tube, whereby a tube/mandrel combination is formed;

heating the tube/mandrel combination to an elevated temperature sufficient to cause the mandrel to expand to a cross-sectional size that corresponds to a desired inside cross-sectional size for said tube;

maintaining the tube/mandrel combination at said elevated temperature for a time sufficient to substantially relieve residual stresses in said tube; and then cooling said tube/mandrel combination to a temperature at which said tube and said mandrel can be readily separated.

12. The process set forth in claim 9 wherein the step of welding the first and second tubes comprises the steps of:

aligning the end of said first tube with the end of said second tube to form a seam therebetween; and then forming a circumferential weld around the tubes to join them together.

13. The process set forth in claim 9 wherein the tube/mandrel combination is heated to a temperature of about 1400°–1450° F.

14. The process set forth in claim 10 wherein the channel has a circular cross-section.

15. The process according to claim 11 wherein the step of heating the tube/mandrel combination comprises the steps of:

placing the tube/mandrel combination in a pressure vessel and then closing and sealing the pressure vessel;

evacuating the pressure vessel to remove atmospheric gases; and then placing the pressure vessel in a heat treating furnace.

16. The process set forth in claim 15 further comprising the step of backfilling the pressure vessel with an inert gas after it has been evacuated.

* * * * *